US011573036B2

(12) United States Patent
Dong et al.

(10) Patent No.: US 11,573,036 B2
(45) Date of Patent: Feb. 7, 2023

(54) GAS-LIQUID SEPARATOR AND HEAT EXCHANGE SYSTEM

(71) Applicant: Sanhua Holding Group, Co., Ltd., Hangzhou (CN)

(72) Inventors: Junqi Dong, Hangzhou (CN); Li Li, Hangzhou (CN)

(73) Assignee: Sanhua Holding Group, Co., Ltd., Hangzhou (CN)

( * ) Notice: Subject to any disclaimer, the term of this patent is extended or adjusted under 35 U.S.C. 154(b) by 154 days.

(21) Appl. No.: 16/942,385

(22) Filed: Jul. 29, 2020

(65) Prior Publication Data

US 2020/0355417 A1 Nov. 12, 2020

Related U.S. Application Data

(63) Continuation of application No. PCT/CN2019/075911, filed on Feb. 22, 2019.

(30) Foreign Application Priority Data

Feb. 24, 2018 (CN) ..... 201810156463.5
Feb. 24, 2018 (CN) ..... 201810156666.4

(51) Int. Cl.
*F25B 43/00* (2006.01)

(52) U.S. Cl.
CPC ..... *F25B 43/006* (2013.01); *F25B 2400/23* (2013.01)

(58) Field of Classification Search
CPC ..... F25B 43/00; F25B 43/02; F25B 43/006; F25B 2400/16; F25B 2400/23;
(Continued)

(56) References Cited

U.S. PATENT DOCUMENTS 4,217,765 A * 8/1980 Ecker ..... F28D 7/08 62/503
4,840,678 A * 6/1989 van der Schaaf ..... C13B 25/003 127/2

(Continued)

FOREIGN PATENT DOCUMENTS

CN 102869452 A 1/2013
CN 203837333 U 9/2014

(Continued)

OTHER PUBLICATIONS

First Office Action for Chinese Application No. 201810156666.4, dated Jan. 3, 2020.

(Continued)

*Primary Examiner* — Miguel A Diaz
(74) *Attorney, Agent, or Firm* — Wolf, Greenfield & Sacks, P.C.

(57) ABSTRACT

A gas-liquid separator includes a first cylinder, a second cylinder, a heat exchange pipe, a flow guide pipe, a distribution portion, and a lower sealing cover. The gas-liquid separator has a first cavity and a second cavity. The second cavity includes at least the space located in the first cylinder. The distribution portion includes a first passage. One end of the first passage is communicated with that of the flow guide pipe. The other end of the flow guide pipe is communicated with the second cavity. The other end of the first passage is communicated with the first cavity. The lower sealing cover is located at the other side far away from the distribution portion. The gas-liquid separator further includes a flow passage located, at least in part, in the lower sealing cover, communicated with the first cavity and communicated with the second cavity.

18 Claims, 13 Drawing Sheets

(58) Field of Classification Search
CPC .. F25B 2400/03; F25B 45/00; F25B 2345/00; F25B 2345/001; F25B 2345/002
See application file for complete search history.

(56) References Cited

U.S. PATENT DOCUMENTS

| | | | | |
|---|---|---|---|---|
| 6,298,687 | B1 | 10/2001 | Dienhart et al. | |
| 6,463,757 | B1 | 10/2002 | Dickson et al. | |
| 6,499,534 | B1 * | 12/2002 | Tawney | F28F 9/22 165/156 |
| 6,612,128 | B2 | 9/2003 | Dickson et al. | |
| 2003/0121648 | A1 * | 7/2003 | Hong | F25B 43/006 165/154 |
| 2007/0129199 | A1 | 6/2007 | Tanaka et al. | |
| 2007/0289723 | A1 | 12/2007 | Koster et al. | |
| 2008/0000261 | A1 | 1/2008 | Klotten et al. | |
| 2011/0303768 | A1 | 12/2011 | Cornet et al. | |
| 2016/0084581 | A1 | 3/2016 | Ye | |
| 2016/0195306 | A1 | 7/2016 | Junge et al. | |
| 2017/0307262 | A1 | 10/2017 | Foerster et al. | |

FOREIGN PATENT DOCUMENTS

| | | | | | |
|---|---|---|---|---|---|
| CN | 105423649 | A | | 3/2016 | |
| CN | 105509368 | A | | 4/2016 | |
| CN | 105805990 | A | | 7/2016 | |
| CN | 205825523 | U | | 12/2016 | |
| CN | 106796064 | A | | 5/2017 | |
| CN | 112432403 | A | * | 3/2021 | F25B 39/00 |
| DE | 3119440 | A1 | | 12/1982 | |
| DE | 10 2006 017 432 | A1 | | 10/2007 | |
| DE | 102008059541 | A1 | | 6/2010 | |
| DE | 102008059543 | A1 | | 6/2010 | |
| DE | 102014005576 | A1 | * | 10/2015 | F25B 40/00 |
| DE | 102014207660 | A1 | * | 10/2015 | F28D 7/024 |
| DE | 102014220403 | A1 | * | 4/2016 | F25B 21/02 |
| DE | 102017211857 | A1 | * | 1/2019 | |
| EP | 0819892 | A2 | | 1/1998 | |
| EP | 0819892 | A3 | | 1/1999 | |
| EP | 1 640 676 | B1 | | 10/2007 | |
| EP | 2 192 368 | A2 | | 6/2010 | |
| EP | 2937658 | A1 | * | 10/2015 | F28D 7/024 |
| GB | 2383631 | A | * | 7/2003 | F25B 40/00 |
| JP | 2007-071511 | A | | 3/2007 | |
| JP | 2007-100766 | A | | 4/2007 | |
| JP | 2007-278688 | A | | 10/2007 | |
| JP | 2018076993 | A | * | 5/2018 | B60H 1/00335 |
| KR | 10-2008-0079189 | A | | 8/2008 | |
| KR | 10-2012-0070840 | A | | 7/2012 | |
| WO | WO-2019161785 | A1 | * | 8/2019 | F25B 40/00 |

OTHER PUBLICATIONS

Second Office Action for Chinese Application No. 201810156666.4, dated Jul. 2, 2020.
First Office Action for Chinese Application No. 201810156463.5, dated Apr. 9, 2020.
Meizhong, Heat exchanger principles and design. Southeast University Press, Fifth Edition, Jul. 31, 2014:168-71.
Cheng et al., Packaging structure design. China Light Industry Press, Fourth Edition. Jun. 30, 2014:385-7.
Extended European Search Report for European Application No. 19758012.9, dated Sep. 27, 2021.
International Search Report and Written Opinion for International Application No. PCT/CN2019/075911, dated May 28, 2019.
Second Office Action for Chinese Application No. 201810156463.5, dated Nov. 24, 2020.
Li et al., Methanol production technology and operation. Beijing Institute of Technology Press. Aug. 31, 2013;1:190-1.

* cited by examiner

GAS-LIQUID SEPARATOR AND HEAT EXCHANGE SYSTEM

CROSS-REFERENCE TO RELATED APPLICATIONS

The present application is a Continuation-In-Part application of PCT Application No. PCT/CN2019/075911, filed on Feb. 22, 2019, which claims the priorities to Chinese Patent Applications No. 2018101566664, titled "GAS-LIQUID SEPARATOR AND HEAT EXCHANGE SYSTEM", filed on Feb. 24, 2018, and No. 2018101564635, titled "GAS-LIQUID SEPARATOR AND HEAT EXCHANGE SYSTEM", filed on Feb. 24, 2018, the entire contents of which are incorporated into this application by reference.

FIELD

The present application relates to the technical field of air conditioning, and in particular to a gas-liquid separator and a heat exchange system.

BACKGROUND

In an air conditioning system, the gaseous refrigerant, which is sucked at a suction side, is compressed and then is discharged by a compressor. A gas-liquid separator may be installed before the compressor to reduce the liquid impact of the compressor. In addition, an internal heat exchanger is used in a system circuit to exchange heat between low temperature refrigerant from the evaporator and high temperature refrigerant from a condenser, so as to increase the temperature of the refrigerant flowing into the compressor. Therefore, a technical solution that can realize the above requirements needs to be provided.

SUMMARY

According to a first aspect of the embodiments of the present application, a gas-liquid separator is provided.

Specifically, the present application is achieved by the following technical solutions.

A gas-liquid separator includes a first cylinder, a second cylinder, a heat exchange pipe, a flow guide pipe, a distribution portion and a lower sealing cover. The first cylinder is located at an inner side of the second cylinder. The gas-liquid separator has a first chamber and a second chamber which are in communication with each other. The first chamber is located in the second cylinder and outside the first cylinder. The second chamber at least includes the space located in the first cylinder. The heat exchange pipe is located outside the first cylinder. The distribution portion is fixed to the second cylinder. The distribution portion has a first passage. The flow guide pipe is fixed to the distribution portion. One end of the first passage is in communication with one end of the flow guide pipe, the other end of the flow guide pipe is in communication with the first chamber, the other end of the first passage is in communication with the first chamber. The lower sealing cover is fixed to the second cylinder. The lower sealing cover is located at the other side relatively away from the distribution portion. The gas-liquid separator further includes a flow passage, and at least part of the flow passage is located in the lower sealing cover, the flow passage is in communication with the first chamber, and in communication with the second chamber through the first chamber.

As may be seen from the aforementioned technical solutions, according to the present application, the first passage for communicating the first chamber and the second chamber is provided in the distribution portion, one end of the flow guide pipe is in communication with the second chamber, and the other end of end of the flow guide pipe is in communication with the first passage, the gaseous refrigerant can flow into the first chamber through the first passage and exchange heat with a heat exchange pipe arranged outside the first cylinder, relatively increasing the temperature of the gaseous refrigerant after separation. It should be understood that the above general description and the following detailed description are merely exemplary and explanatory, and do not intend to limit the scope of the present application.

BRIEF DESCRIPTION OF THE DRAWINGS

The accompanying drawings, which are incorporated in the specification and constitute a part of the specification, illustrate embodiments of the present application and, together with the specification, serve to explain the principles of the present application.

DETAILED DESCRIPTION OF THE EMBODIMENTS

The technical solution according to the embodiments of the present application will be described clearly and completely as follows in conjunction with the drawings. Apparently, the described embodiments are only a few rather than all of the embodiments according to the present application. Any other embodiments obtained by those skilled in the art based on the embodiments in the present application without any creative work fall in the scope of the present application.

Exemplary embodiments are described in detail herein, and examples of the exemplary embodiments are shown in the accompanying drawings. When the following descriptions relate to the accompanying drawings, unless indicated otherwise, same numbers in different accompanying drawings represent same or similar elements. The implementations described in the following exemplary embodiments do not represent all implementations consistent with the present application. On the contrary, the implementations are merely examples of apparatuses and methods that are described in detail in the appended claims and that are consistent with some aspects of the present application.

The terminology used in the present application is only for purpose of describing the specific embodiments, and is not intended to limit the present application. The singular forms of "a", "said" and "the" used in the present application and the appended claims are also intended to include the plural form, unless the context clearly indicates other meanings. It should also be understood that terms "and/or" used in the present application refer to any or all possible combinations including one or multiple associated listed items.

It should be understood that, although the present application may use terms such as first, second, third and the like to describe various information, these information should not be limited to these terms. These terms are merely used to distinguish the same type of information from each other. For example, without departing from the scope of the present application, the first information may be also referred to as the second information. Similarly, the second information may be also referred to as the first information. Depending on the context, the word "if" as used here may be interpreted as "when" or "while" or "in response to the determination".

The exemplary embodiment of the present application is described in detail in conjunction with the accompanying drawings as follows. The embodiments and features in the embodiments may be combined with each other without a conflict.

Figure 1:
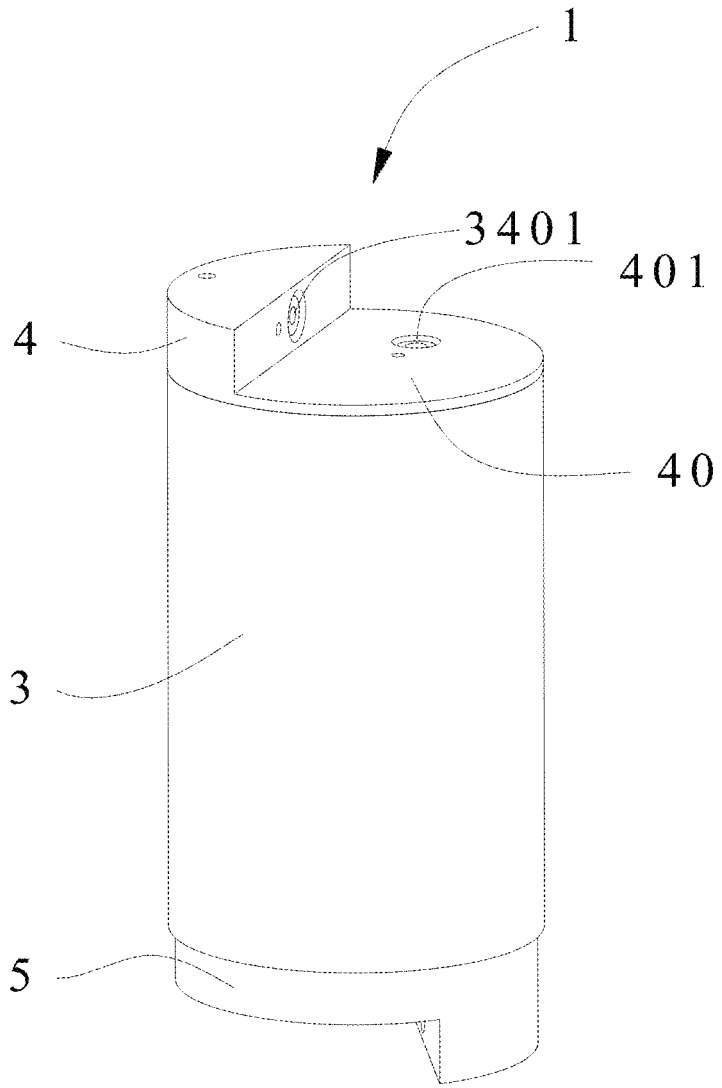
FIG. 1 is a schematic perspective view showing the assembly of a gas-liquid separator according to a first exemplary embodiment of the present application.

FIG. 1 is a schematic perspective view showing the assembly of the gas-liquid separator according to an exemplary embodiment of the present application. The gas-liquid separator may be applied to various heat exchange systems, and suitable for many fields such as a household air conditioner, a commercial air conditioner, an automobile and the like.

Referring to FIGS. 1 to 14, a heat exchange system 100 at least includes an evaporator and a compressor which are connected by a pipeline. The gas-liquid separator 1 is provided between the evaporator and the compressor. An outlet of the evaporator is connected to the first through hole 401 of the gas-liquid separator through the pipeline, and the compressor is connected to an outlet of the gas-liquid separator.

Figure 2:
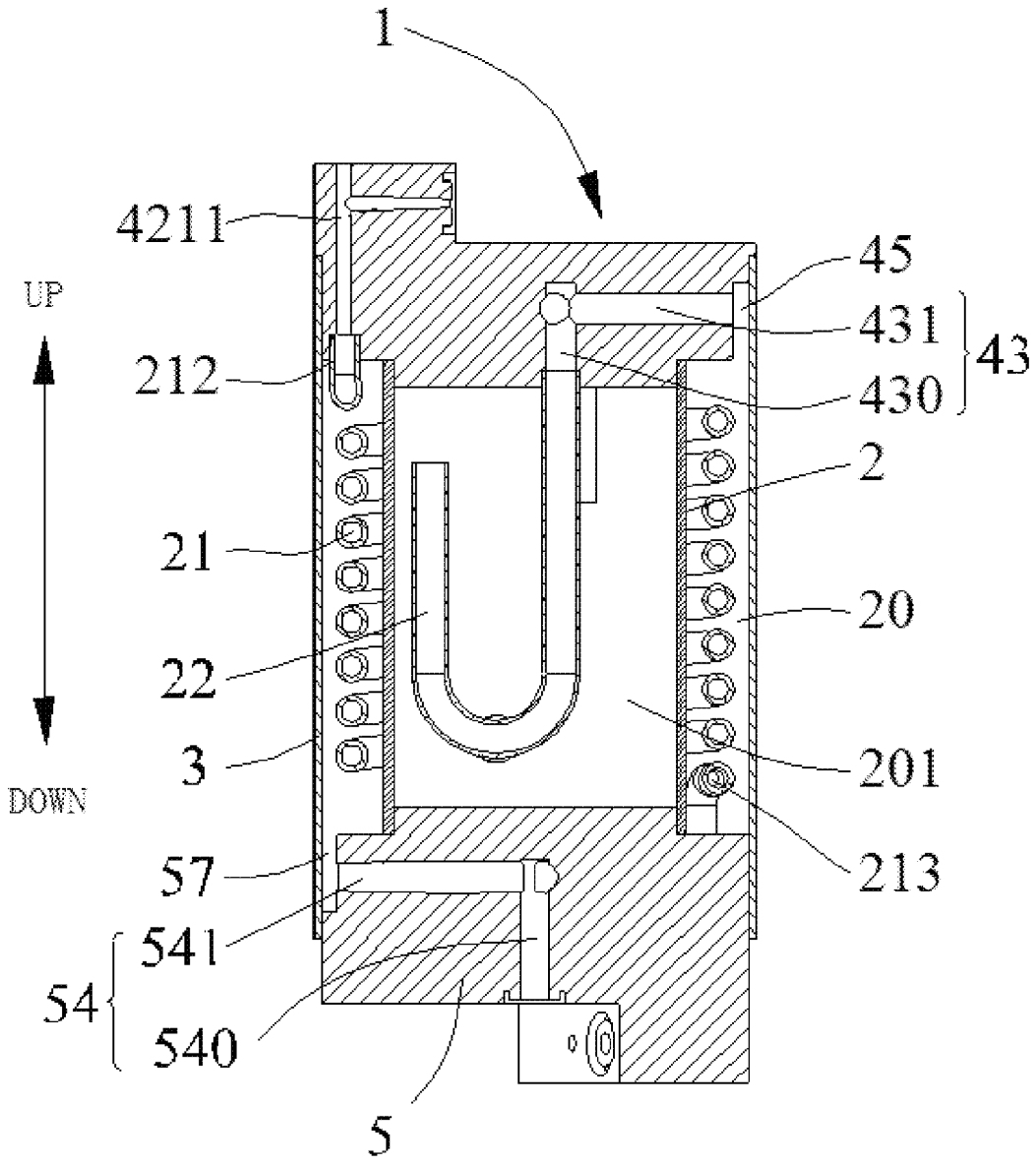
FIG. 2 is a schematic sectional view showing the assembly of the gas-liquid separator according to the first exemplary embodiment of the present application.

As shown in FIGS. 1 and 2, the gas-liquid separator 1 includes a first cylinder 2, a second cylinder 3 and a heat exchange pipe 21. The second cylinder 3 is located outside the first cylinder 2. The gas-liquid separator 1 has a first chamber 20 and a second chamber 201 which are in communication with each other. The first chamber 20 is located in the second cylinder 3 and outside the first cylinder 2. The second chamber 201 at least includes a space located in the first cylinder 2.

The heat exchange pipe 21 is located outside the first cylinder 2. In an embodiment, the heat exchange pipe 21 is arranged in the first chamber 20.

The gas-liquid separator 1 further includes a distribution portion 4 which is connected to the second cylinder 3. In some embodiments, the distribution portion 4 may be fixed to the second cylinder 3.

According to an embodiment of the present application, both the first cylinder 2 and the second cylinder 3 are hollow cylinders, and an outer diameter of the first cylinder 2 is less than an inner diameter of the second cylinder 3. The second chamber 201 is formed in the first cylinder 2, and a gas-liquid distribution assembly is provided in the second chamber 201. An upper end face of the first cylinder 2 abuts against the distribution portion 4.

According to another embodiment of the present application, the first cylinder 2 and the second cylinder 3 have annular side walls and a bottom wall 25. An upper end of the first cylinder 2 further may be covered with an end cap. The second chamber 201 is formed in the first cylinder 2, and the gas-liquid distribution assembly is provided in the second chamber 201.

The first chamber 20 is a chamber enclosed by an outer wall face of the first cylinder 2 and an inner wall face of the second cylinder 3.

Figure 5:
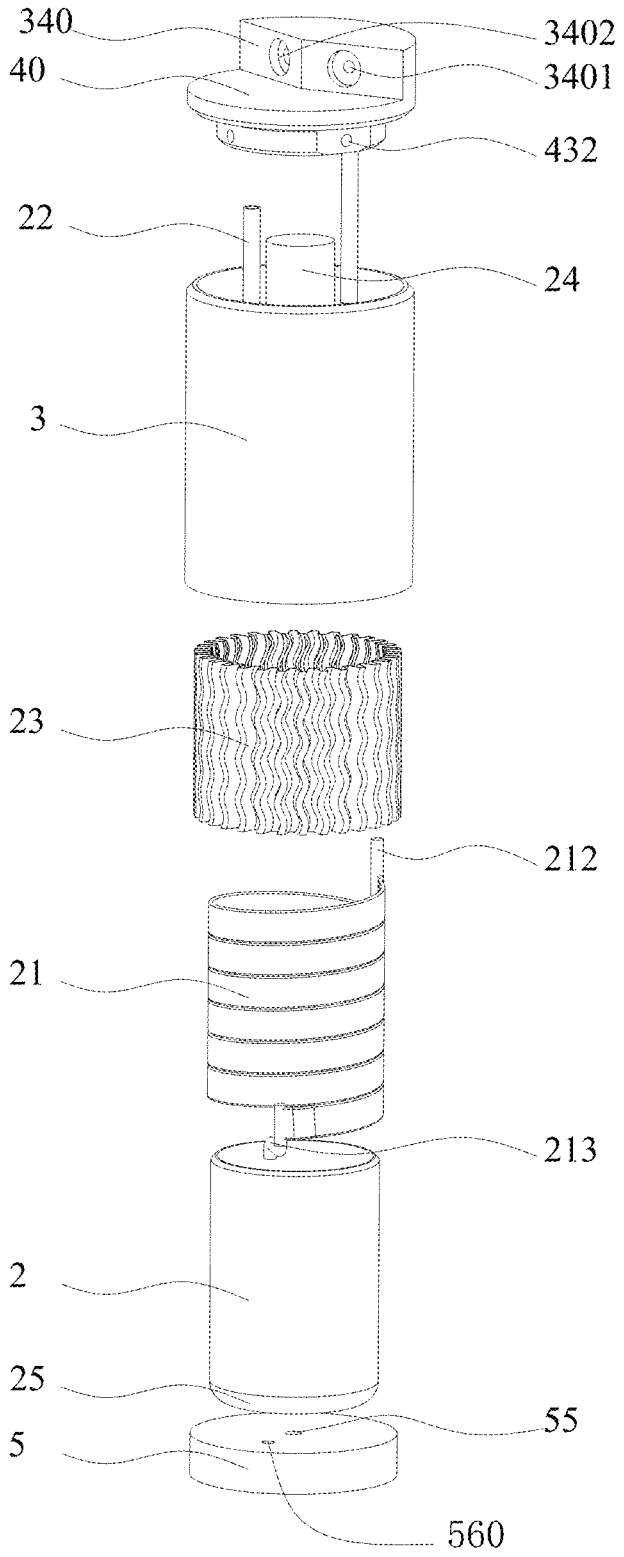
FIG. 5 is a schematic exploded view of a gas-liquid separator according to a third exemplary embodiment of the present application.
Figure 6:
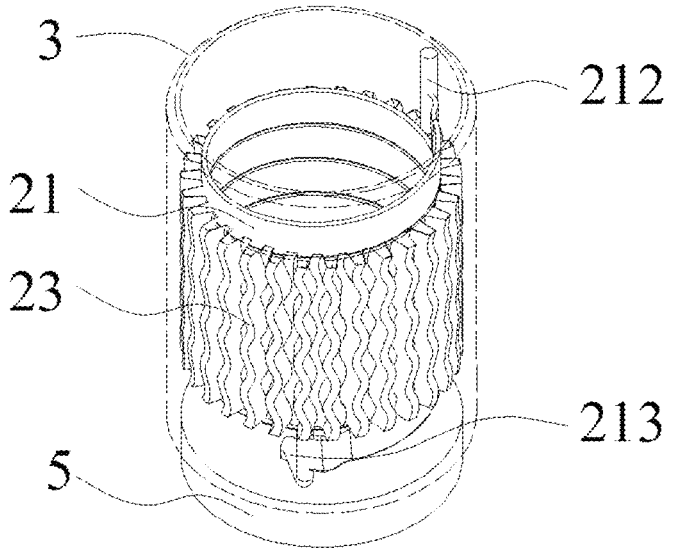
FIG. 6 is a schematic perspective view of the gas-liquid separator according to the third exemplary embodiment of the present application, which does not assemble the distribution portion, the second cylinder and the first cylinder.

As shown in FIGS. 2 and 5, further, the first chamber 20 is a low temperature refrigerant passage, and the heat exchange pipe 21 is a high temperature refrigerant passage.

Figure 11:
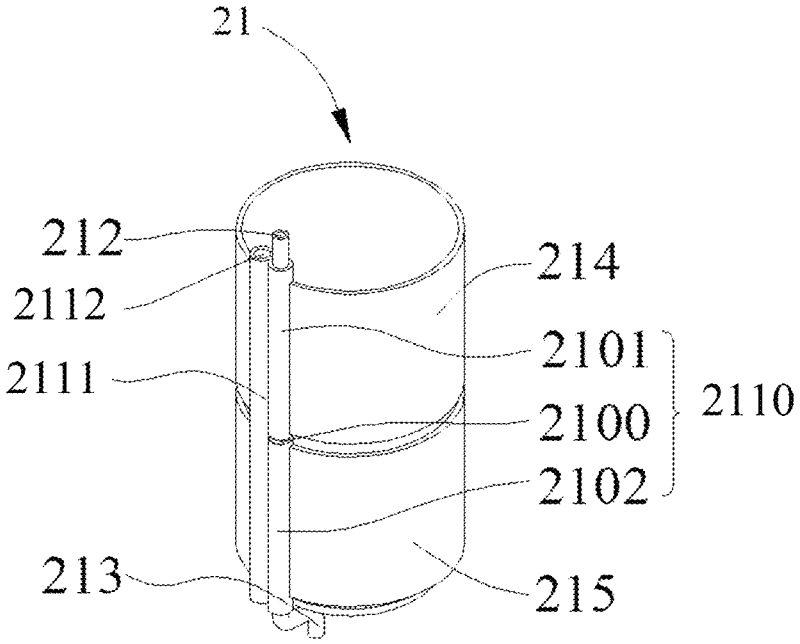
FIG. 11 is a schematic perspective view of a heat exchange pipe of the gas-liquid separator according to the fourth exemplary embodiment of the present application.

According to an embodiment of the present application, the heat exchange pipe 21 is coiled in a direction to form an approximate cylindrical shape. One end of the heat exchange pipe 21 is provided with a second connector 213 connected to the distribution portion 4, and the other end of the heat exchange pipe 21 is provided with a first connector 212 connected to a high temperature refrigerant discharge passage. The heat exchange pipe 21 is surrounded by the low temperature gaseous refrigerant flowing in the first chamber 20, so that the low temperature refrigerant in the first chamber 20 fully exchanges heat with the high temperature refrigerant flowing in the heat exchange pipe 21. As shown in FIGS. 2 and 11, a cross section of the heat exchange pipe 21 may be circular, and the heat exchange pipe 21 further may be a strip-shaped flat tube 214 or 215. Further, the strip-shaped flat tubes 214, 215 further may be provided with multiple micro-channels penetrating through whole flat tubes 214, 215. In another embodiment, the cross section of the heat exchange pipe 21 may also be rhombus, rectangle or other shapes or any combination of two or more than two shapes.

Figure 7:
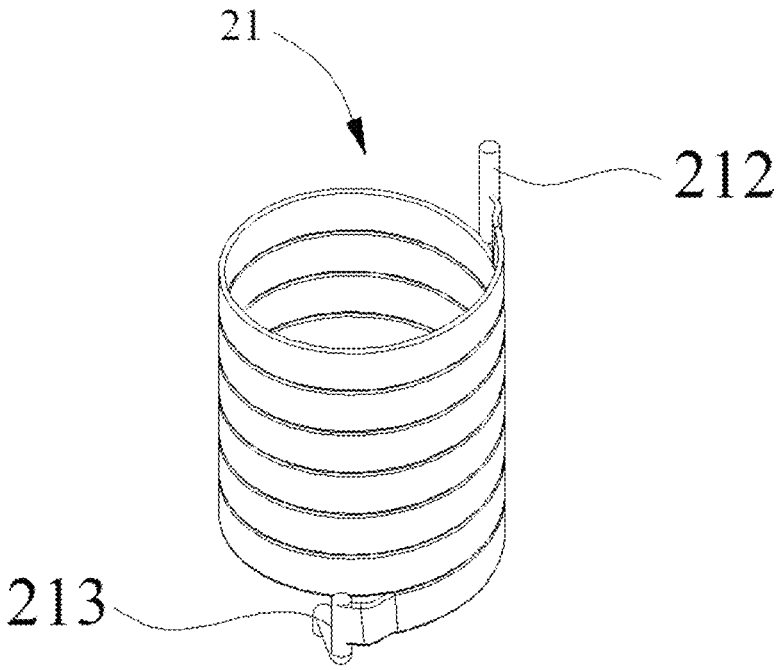
FIG. 7 is a schematic perspective view of a heat exchange pipe of the gas-liquid separator according to the third exemplary embodiment of the present application.

Further, as shown in FIG. 7, an opening direction of the first connector 212 is opposite to an opening direction of the second connector 213.

According to another embodiment of the present application, as shown in FIG. 11, the heat exchange pipe 21 includes multiple flat tubes 214, 215 arranged in parallel with each other and collecting pipes in communication with the flat tubes 214, 215. The flat tubes 214, 215 are bent to be approximately cylindrical and may be nested in the first chamber 20. The collecting pipes may include a first collecting pipe 2110 and a second collecting pipe 2111. One end of the flat tubes 214, 215 is connected with the first collecting pipe 2110, and the other end of the flat tubes 214, 215 is connected with the second collecting pipe 2111. The first collecting pipe 2110 and the second collecting pipe 2111 are arranged approximately in parallel.

Figure 10:
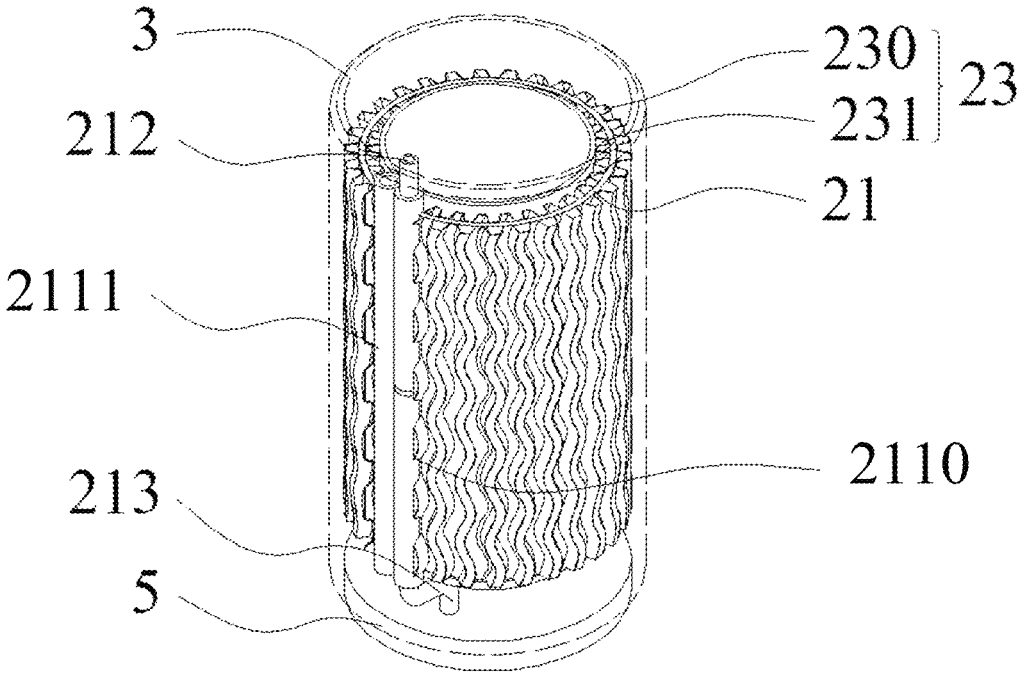
FIG. 10 is a schematic perspective view of a gas-liquid separator according to a fourth exemplary embodiment of the present application, which does not assemble the distribution portion, the second cylinder and the first cylinder.

As shown in FIGS. 10 and 11, one end of the first collecting pipe 2110 is provided with the first connector 212 connected to the distribution portion 4, and the other end of the first collecting pipe 2110 is provided with the second connector 213. The second collecting pipe 2111 is a hollow cylindrical shape, and a leakproof end cap 2112 is provided at each of two ends of the second collecting pipe 2111. Further, the first collecting pipe 2110 is provided with a partition plate 2100. Along an axial direction of the first collecting pipe 2110, the partition plate 2100 divides the first collecting pipe 2110 into multiple chambers which are independent of each other. Particularly, the partition plate 2100 divides the first collecting pipe 2110 into two chambers which are independent of each other, that is, a first chamber 2101 and a second chamber 2102. The second connector 213 is in communication with the first chamber 2101, and the first connector 212 is in communication with the second chamber 2102.

After flowing into first chamber 2101 from the first connector 212, the high temperature refrigerant flows into the second collecting pipe 2111 along the micro-channel in the flat tube 214 of an upper half portion, and then flows into the flat tube 215 of a lower half portion from the second collecting pipe 2111, and then flows into the second chamber 2102 from the flat tube 215 of the lower half portion, and then flows out of the second connector 213.

Further, the flat tubes 214, 215 may be two wide format flat tubes, that is, both the flat tube 214 of the upper half portion and the flat tube 215 of the lower half portion are the wide format flat tubes. At this time, the high temperature refrigerant only need to surround the first cylinder 2 twice, the heat exchange is completed. Therefore, the path of the heat exchange is short, and the flow resistance of the refrigerant is small.

Figure 3:
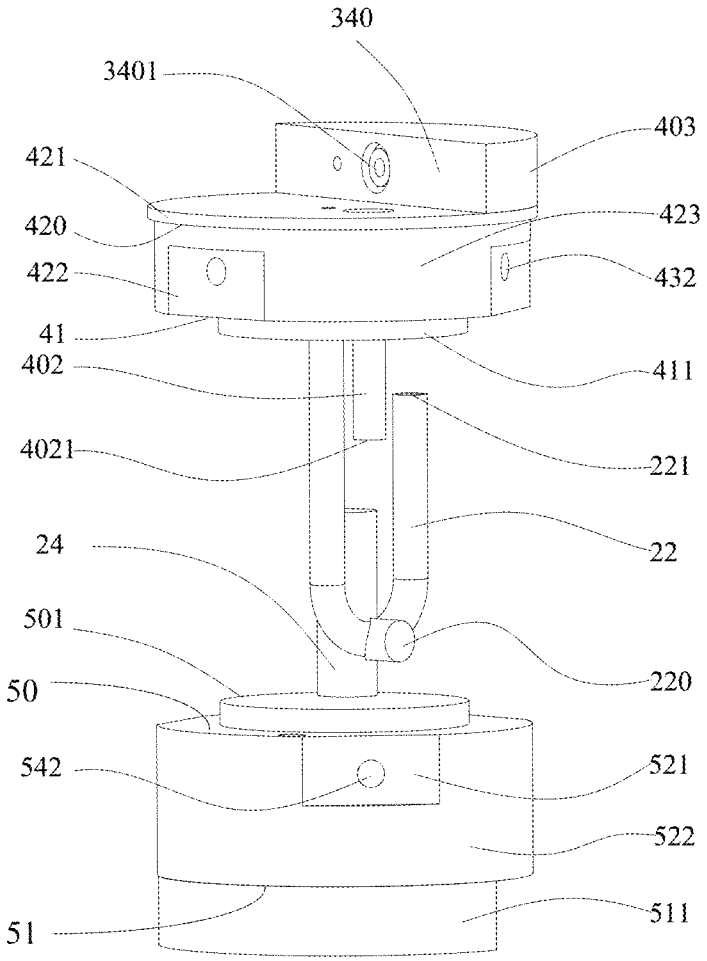
FIG. 3 is a schematic perspective view of the gas-liquid separator according to the first exemplary embodiment of the present application, which does not assemble a first cylinder and a second cylinder.
Figure 4:
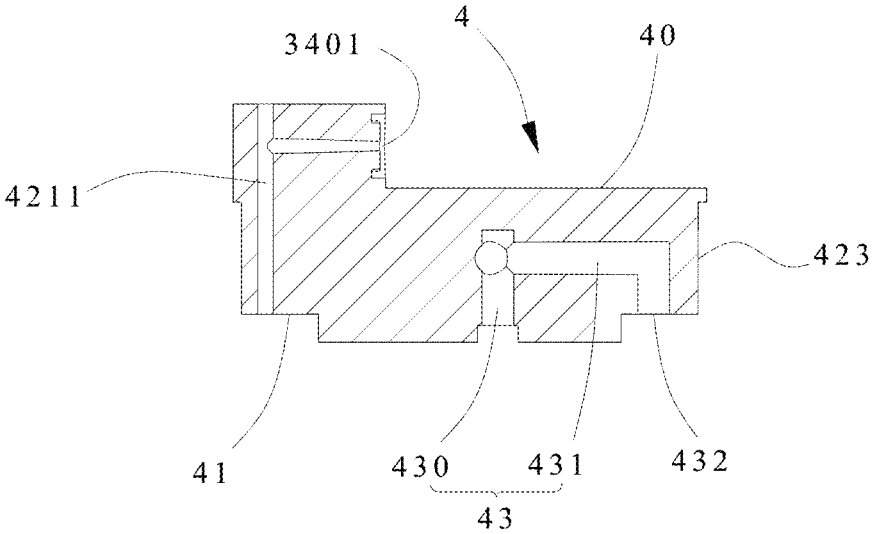
FIG. 4 is a schematic sectional view of a distribution portion of a gas-liquid separator according to a second exemplary embodiment of the present application.

As shown in FIGS. 3, 4 and 5, the distribution portion 4 covers on an upper end of the second cylinder 3, and an upper end face of the first cylinder 2 abuts against the distribution portion 4. In some embodiments, the distribution portion 4 is fixedly connected to the second cylinder 3 by welding.

In the illustrated embodiment, the gas-liquid separator 1 further includes a flow guide pipe 22 and a connecting pipe 402. The connecting pipe 402 is connected to the distribution portion 4. In some embodiments, the connecting pipe 402 is fixed to the distribution portion. The flow guide pipe 22 is connected to the distribution portion 4. In some embodiments, the flow guide pipe 22 is fixed to the distribution portion. At least part of the connecting pipe 402 and at least part of the flow guide pipe 22 are located in the second chamber 201. The distribution portion 4 includes a first through hole 401, and the connecting pipe 402 is in communication with the first through hole 401.

The distribution portion 4 is approximately circular and includes a first end face 40 away from the second cylinder 3, a second end face 41 opposite to the first end face 40 and a step face 420. The first end face 40 is a plane away from the second cylinder 3, and the first end face 40 is opposite to the second end face 41. The step face 420 divides a side wall face of the distribution portion 4 into two segments, that is, a first side wall face 421 and a second side wall face 423. An outer extension of the step face 420 is connected to the first side wall face 421, and an inner extension of the step face 420 is connected to the second side wall face 423. A part of the second side wall face 423 is recessed inward to form a first surface 422, an upper end face of the second cylinder 3 abuts against the step face 420, and a first gap 45 as shown in FIG. 2 is formed between the first surface 422 and the inner wall face of the second cylinder 3.

An upper end face of the first cylinder 2 is lower than the upper end face of the second cylinder 3. At least part of the first side wall face 421 fits the inner wall face of the second cylinder 3, that is, the height of an end face of the second cylinder 3 is consistent with the height of the first end face 40 of the distribution portion 4, or the upper end face of the second cylinder 3 is lower than the first end face 40. In another embodiment of the present application, referring to FIG. 3, the upper end face of the second cylinder 3 abuts against the step face 420, thereby achieving to seal the distribution portion 4 with the upper end of the second cylinder 3.

Further, as shown in FIGS. 2, 3 and 4, the distribution portion 4 has a peripheral wall portion and a first passage 43. An end opening of the first passage 43 is located in the peripheral wall portion. The flow guide pipe 22 is fixed to the distribution portion 4. An end of the first passage 43 is in communication with an end of the flow guide pipe 22, the other end of the flow guide pipe 22 is in communication with the second chamber 201, and the other end of the first passage 43 is in communication with the first chamber 20. The first passage 43 includes a distribution hole 431. An end opening of the distribution hole 431 is configured as a distribution opening 432 which is located at the other end of the first passage 43. The distribution hole 431 is in communication with the first chamber 20, and the distribution hole 431 is in communication with the second chamber 201. A peripheral wall portion of the distribution portion 4 is configured as a part of a wall face defining the first chamber 20.

In some embodiments, the first passage 43 may be distributed along a radial direction of the distribution portion 4. At least part of the first passage 43 is in communication with the first chamber 20 and the second chamber 201. At least part of the first passage 43 includes the distribution hole 431. The distribution hole 431 extends towards an interior of the distribution portion 4 and has the distribution opening 432 at an end far away from a vertical axis of the distribution portion 4. In some embodiments, the distribution hole 431 extends in the radial direction of the distribution portion 4.

The distribution portion 4 includes the first side wall face 421, the second side wall face 423 and the step face 420. An outer portion of the step face 420 is connected to the first side wall face 421 and an inner portion of the step face 420 is connected to the second side wall face 423. A part of the second side wall face 423 is recessed inwardly to form the first surface 422. The upper end face of the second cylinder 3 abuts against the step face 420. A first gap 45 is defined between the first surface 422 and the inner wall face of the second cylinder 3. The first surface 422 is a part of the wall face defining the first chamber 20, and the distribution opening 432 is arranged at the first surface 422.

Referring to FIGS. 2 and 3, at least part of the second side wall face 423 forms a part of the wall face defining the first chamber 20. Specifically, a part of the second side wall face 423 is recessed inwardly to form the first surface 422, and a remaining part of the second side wall face 423 mated with the inner wall face of the second cylinder 3. Thus, the first surface 422 forms a part of the wall face defining the first chamber 20, and the first gap 45 is defined between the second cylinder 3 and the first surface 422. More specifically, the second side wall face 423 is approximately an arc shape. A wall face is cut to form a plane first surface 422 from a place where the distribution opening 432 is located. The upper end face of the second cylinder 3 is not lower than the first surface 422. A gap is formed between the inner wall face of the second cylinder 3 and the first surface 422, and belongs to a part of the first chamber 20. In addition, drilling on the first surface 422 is more convenient than drilling on an arc surface, and the machinability is good.

According to another embodiment of the present application, referring to FIG. 4, the upper end of the first cylinder 2 abuts against the second end face 41. The inner wall face of the second cylinder 3 mate with the second side wall face 423. The first surface 422 is located above the second end face 41, that is, the distribution opening 432 is located above the second end face 41. According to other embodiments, a part of the inner wall of the second cylinder 3 mates with the first side wall face 421. The upper end face of the first cylinder 2 abuts against the second end face 41. The distribution opening 432 is arranged at an outer peripheral surface of the second side wall face 423, that is, the first surface 422 is located inside the second side wall face 423.

According to another embodiment of the present application, referring to FIGS. 2, 3 and 4, the distribution opening 432 extends toward a center of a circle of the distribution portion 4 after extending upwardly a predetermined distance to form multiple distribution holes 431. In some embodiments, the distribution opening 432 extends toward the center of the circle of the distribution portion 4 along a radial direction of the distribution portion 4. Multiple distribution holes 431 merge at the axis of the distribution portion 4 and extend downward to form a first hole 430, that is, at least part of the first passage 43 further includes the first hole 430 in communication with the distribution hole 431. The first hole 430 extends in a direction parallel with an axial direction of the distribution portion 4, and penetrates the second end face 41 but does not penetrate the first end face 40.

Figure 8:
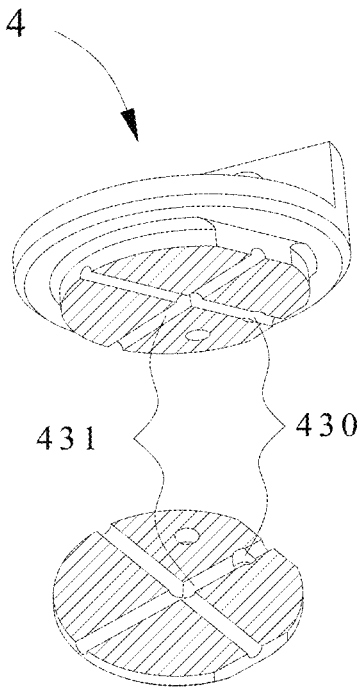
FIG. 8 is a schematic sectional view of a distribution portion of the gas-liquid separator according to the third exemplary embodiment of the present application.

According to other embodiments of the present application, referring to FIGS. 4, 5 and 8, the first hole 430 is in communication with at least one of the distribution holes 431, and the first hole 430 may be arranged far away from the axis of the distribution portion 4. More specifically, multiple distribution holes 431 merge at the axis of the distribution portion 4, that is, the multiple distribution holes 431 are in communication with each other, and the first hole 430 is in communication with one of the distribution holes 431. The first hole 430 is in communication with the second chamber 201, thus the first chamber 20 is in communication with the second chamber 201. After the second chamber 201 of the gas-liquid separator is flowed in the low temperature refrigerant, the low temperature gaseous refrigerant is distributed into the first chamber 20 via the distribution hole 431 in the distribution portion 4, and the low temperature refrigerant in the first chamber 20 exchanges heat with the high temperature refrigerant in the heat exchange pipe 21. The heat exchange pipe 21 is located inside the second cylinder 3 and surrounded by the second cylinder 3. As shown in FIGS. 2 and 3, the flow guide pipe 22 connected to the first hole 430 is placed in the first cylinder 2.

Further, as shown in FIG. 1, the first through hole 401 penetrating through the first end face 40 and the second end face 41 is disposed at a place of the distribution portion 4 far away from the axis, that is, the first through hole 401 penetrates through the distribution portion 4. In some embodiments, the first through hole 401 may be a straight hole whose axis is a straight line. In some embodiments, the first through hole 401 may be a hole whose axis is a curved line or a fold line. As shown in FIG. 2, a lower end opening of the first through hole 401 is connected with the connecting pipe 402 extending vertically and downwardly from the first through hole 401. The low temperature refrigerant in gas-liquid two phase state may flow into the second chamber 201 via the first through hole 401 to complete the separation of the fluid in a gas state and a liquid state.

Further, to improve the reliability of assembling the first cylinder 2 to the distribution portion 4, as shown in FIG. 3, the distribution portion includes a restricting portion 411 which is formed by a part of the second end face 41 extending downwardly, and a side wall face of the restricting portion 411 mates with the inner wall face of the first cylinder 2. The side wall face of the restricting portion 411 mates with the inner wall face of the first cylinder 2. In the present embodiment, a dimension of the restricting portion 411 in the radial direction is smaller than a diameter of the first cylinder 2. Particularly, the diameter of the restricting portion 411 is smaller than the diameter of the first cylinder 2. When the first cylinder 2 is assembled with the distribution portion 4, an outer wall face of the restricting portion 411 abuts against the inner wall face of the first cylinder 2, and the upper end of the first cylinder 2 abuts against the second end face 41 of the distribution portion 4 to achieve the position-limiting for the first cylinder 2.

In another embodiment of the present application, to achieve the sealing for the upper end of the first cylinder 2, the second end face 41 may be provided with a groove matching the upper end of the first cylinder 2. During an assembly process, the upper end of the first cylinder 2 is inserted in the groove to achieve the sealing for the upper end of the first cylinder 2.

According to another embodiment of the present application, as shown in FIGS. 1, 2, 5 and 6, the gas-liquid separator 1 further includes a lower sealing cover 5 which is connected to the first cylinder 2. In some embodiments, the lower sealing cover 5 is connected to the first cylinder 2 by welding. The lower sealing cover 5 covers a lower end of the second cylinder 3. In some embodiments, the lower sealing cover 5 is fixed to the second cylinder 3 and located at the other side relatively away from the distribution portion 4.

As shown in FIGS. 2 and 3, a lower end face of the first cylinder 2 abuts against the lower sealing cover 5. The gas-liquid separator 1 further includes multiple flow passages 54. At least part of the flow passage 54 is located in the lower sealing cover 5. The flow passage 54 is in communication with the first chamber 20, and is in communication with the second chamber 201 through the first chamber 20. In some embodiments, the flow passages 54 are arranged along the radial direction of the distribution portion 5. The flow passage 54 includes a second hole 540 and a confluence hole 541. The second hole 540 penetrates downwardly through a lower end face of the lower sealing cover 5 from the inside of the lower sealing cover 5. The confluence hole 541 is in communication with the second hole 540. In some embodiments, the confluence hole 541 extends in the radial direction of the second hole 540. The confluence hole 541 has a confluence opening 542. The lower sealing cover 5 includes a second surface 521 which defines a part of the wall face of the first chamber 20. The confluence opening 542 is disposed at the second surface 521.

An upper end face of the lower sealing cover 5 may be provided with a groove matching the lower end portion of the first cylinder 2.

Figure 9:
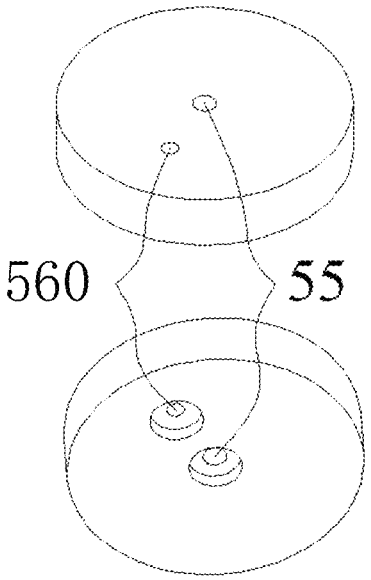
FIG. 9 is a schematic sectional view of a lower sealing cover of the gas-liquid separator according to the third exemplary embodiment of the present application.

As shown in FIGS. 5 and 9, the first cylinder 2 has an annular side wall and a bottom wall 25. A gap may be located between the bottom wall 25 and the lower sealing cover 5. The lower sealing cover 5 is provided with a third through hole 55 penetrating through an upper surface and a lower surface of the lower sealing cover 5. The third through hole 55 makes the first chamber 20 be in communication with the gas-liquid separator 1, and discharges the gaseous refrigerant after heat exchange out of the gas-liquid separator 1.

A support member (not shown) is disposed between the bottom wall 25 and the lower sealing cover 5. An assembly portion for accommodating the support member is provided on the lower sealing cover 5. Further, the third through hole 55 may be disposed at an axis position of the lower sealing cover 5. A gap is defined between the bottom wall 25 of the second cylinder 2 and the lower sealing cover 5, and the support member is disposed in the gap. The assembly portion for accommodating the support member is provided on the lower sealing cover 5, and the assembly portion may be a groove. Thus, the existence of the gap between the first cylinder 2 and the lower sealing cover 5, therefore it is convenient for the gaseous refrigerant to be discharged out of the third through hole 55.

According to another embodiment of the present application, neither the first cylinder 2 nor the second cylinder 3 have no bottom wall, at this time, the lower sealing cover 5 may be approximately circular. As shown in FIGS. 2 and 3, the lower sealing cover 5 includes a third end face 50, a fourth end face 51 and a third side wall face 522. A part of the third side wall face 522 is recessed inwardly to form the second surface 521. A part of the inner wall face of the second cylinder 3 abuts against the third side wall face 522, and a second gap 57 is defined between the second surface 521 and the inner wall face of the second cylinder 3.

Specifically, the third side wall face 522 is provided with a confluence opening 542 in a circumferential direction thereof. The confluence opening 542 extends toward a center of a circle of the lower sealing cover 5 in a diameter direction of the lower sealing cover 5 to form multiple confluence holes 541. Multiple confluence holes 541 merge at the axis of the lower sealing cover 5 and extend downwardly to form the second hole 540 for communicating with an external flow path.

Further, to improve the reliability of assembling the first cylinder 2 to the lower sealing cover 5, the third end face 50 is provided with a groove matching the lower end of the first cylinder 2. During assembly, the lower end of the first cylinder 2 is inserted in the groove to achieve the sealing for the lower end of the first cylinder 2. As shown in FIGS. 5 and 9, the lower sealing cover 5 further may be provided with a fourth through hole 560 in communication with the second connector 213.

As shown in FIG. 3, to improve the reliability of assembling the first cylinder 2 to the lower sealing cover 5, a part of the third end face 50 extends upwardly to form a restricting portion 501, and a side wall face of the restricting portion 501 mates with the inner wall face of the first cylinder 2. In the present embodiment, a dimension of the restricting portion 501 in the radial direction is smaller than the diameter of the first cylinder 2. Particularly, the diameter of the restricting portion 501 is less than the diameter of the first cylinder 2. When the first cylinder 2 is assembled with the lower sealing cover 5, an outer wall face of the restricting portion 501 abuts against the inner wall face of the first cylinder 2, and the lower end of the first cylinder 2 abuts against the third end face 50 of the lower sealing cover 5 to achieve the position-limiting of the first cylinder 2.

Figure 13:
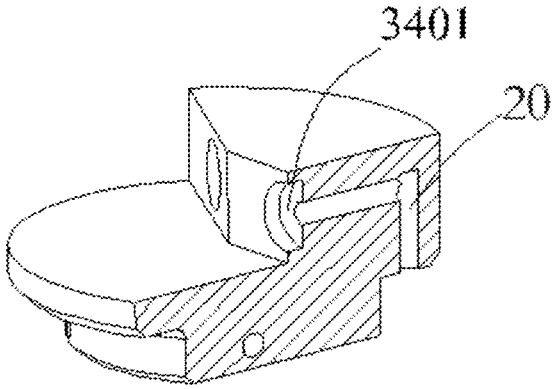
FIG. 13 is a schematic sectional view of the distribution portion of the gas-liquid separator according to the third exemplary embodiment of the present application from another angle.
Figure 14:
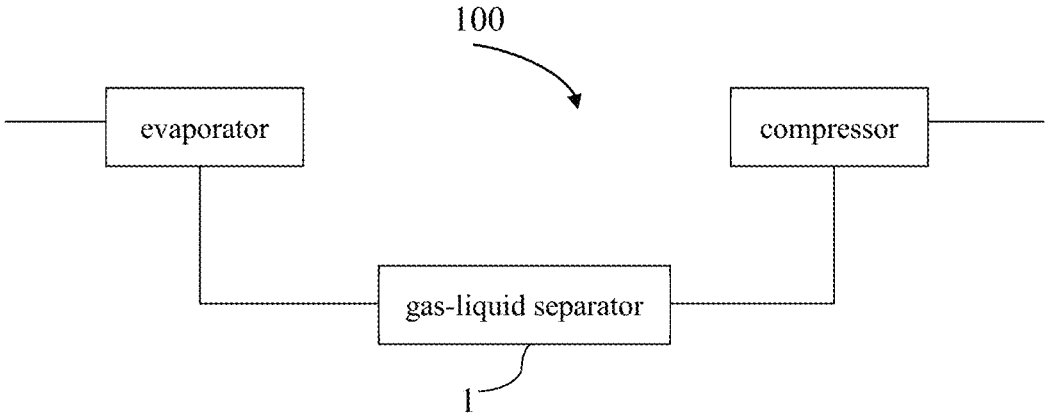
FIG. 14 is a schematic diagram showing the connection of a heat exchange system according to an exemplary embodiment of the present application.

Further, as shown in FIG. 3, the distribution portion 4 includes a connecting portion 403 formed by a part of the first end face 40 extending upwardly therefrom. A part of the first side wall face 421 extends upwardly to form a side wall face of the connecting portion 403. The connecting portion 403 further includes a fourth side wall face 340 which is provided with a first groove 3401. As shown in FIGS. 2 and 13, after the first groove 3401 extends toward an interior of the connecting portion 403 by a predetermined distance, the first groove 3401 extends downwardly in a direction parallel to an axis of the distribution portion 4 and penetrates the second end face 41 to be in communication with the first chamber 20. In some embodiments, the first groove 3401 extends in the radial direction of the connecting portion 403.

Figure 12:
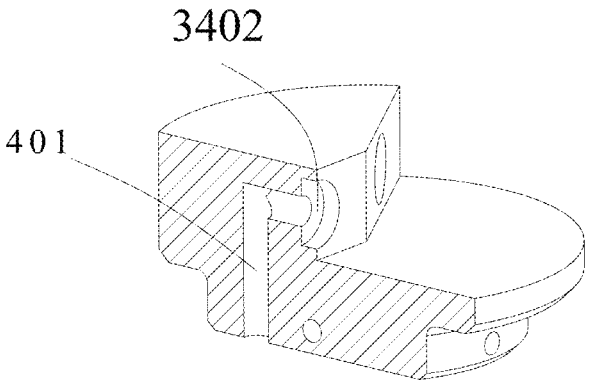
FIG. 12 is a schematic sectional view of the distribution portion of the gas-liquid separator according to the third exemplary embodiment of the present application from an angle.

The fourth side wall face 340 further may be provided with a second groove 3402. As shown in FIGS. 2 and 12, after the second groove 3402 extends toward the interior of the connecting portion 403 by a predetermined distance, the second groove 3402 extends downwardly in the direction parallel to the axis of the distribution portion 4 to be in communication with the first through hole 401. In some embodiments, the second groove 3402 extends in the radial direction of the connecting portion 403. Certainly, referring to FIGS. 5, 12 and 13, the fourth side wall face 340 further may be divided into two planes which are not in the same plane. The first groove 3401 and the second groove 3402 are located in one of the two planes, respectively. The dimension of the hole of the distribution portion 4 relative to the first chamber 20 may be increased by providing the connecting portion 403, which facilitates the formation of a large step hole and easy installation.

In some embodiments, as shown in FIG. 3, a part of the fourth end face 51 extends downwardly to form a connecting portion 511. A large step hole may be formed by providing the connecting portion 511 to facilitate the installation of the gas-liquid separator 1.

Figure 23:
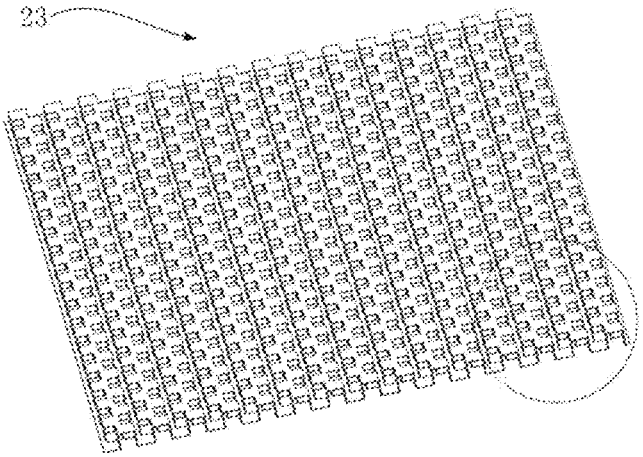
FIG. 23 is a schematic view of a heat dissipation member of the gas-liquid separator according to the exemplary embodiment of the present application.
Figure 24:
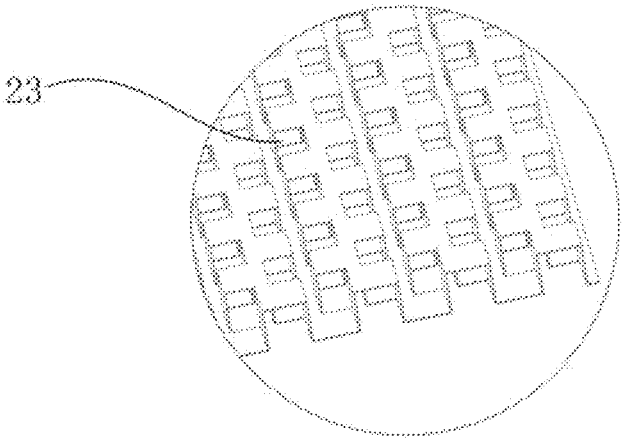
FIG. 24 is a partially enlarged schematic view of FIG. 23.

A heat dissipation member 23 is further provided in the first chamber 20. As shown in FIG. 10, the heat dissipation member 23 is bent into a cylindrical shape. The heat dissipation member 23 is connected to the outer wall face of the first cylinder 1 and/or the inner wall face of the second cylinder 3. In some embodiments, the heat dissipation member 23 further may attach to the heat exchange pipe 21. Further, the heat dissipation member 23 may include a first heat dissipation member 231 and a second heat dissipation member 230. The first heat dissipation member 231 is disposed inside the heat exchange pipe 21, and the second heat dissipation member 230 is sleeved outside the heat exchange pipe 21. According to the present application, each of two sides of the heat exchange pipe 21 is provided with the heat dissipation member 23 to improve the heat exchange efficiency. In an embodiment of the present application, the heat dissipation member 23 as shown in FIGS. 23, 24 may be formed by successively connecting multiple sheet-shaped units of a "Ω" shape end to end, to increase a heat dissipation area. Protrusions of the "Ω" shape of heat dissipation fins of any two adjacent columns or rows are alternately distributed, thus effectively improving the disturbance to the refrigerant to be exchanged heat. In another embodiment of the present application, the heat dissipation member 23 is formed by pressing a plate inwardly to form continuous grooves of S shape on the plate.

The upper end of the second cylinder 3 abuts against the step face 420 to be welded together or the inner wall of the second cylinder 3 abuts against the first side wall 421 to be welded together, and the inner wall of the second cylinder 3 is welded to the third side wall 522 to achieve the sealing for the second cylinder 3. The upper end of the first cylinder 2 abuts against the second end face 41 and is received in the groove at the second end face 41, or the upper end of the first cylinder 2 is mounted outside the restricting portion 411, and the lower end of the first cylinder 2 abuts against the third end face 50 and is received in the groove, thus achieving the sealing for the first cylinder 2.

Further, as shown in FIG. 2, the first gap 45 is formed between the second side wall 423 and the second cylinder 3, so that the distribution opening 432 is in communication with the first chamber 20. The second gap 57 is formed between the second surface 521 and the inner wall of the second cylinder 3, so that the confluence opening 542 is in communication with the first chamber 20. To ensure that the low temperature refrigerant uniformly flows into/flows out of the first chamber 20, the distribution opening 432 and the confluence opening 542 are generally uniformly arranged. In the present embodiment, three or four distribution openings 432 in communication with each other. The distribution opening 432 equally divides the second side wall 423, so that the distribution of the low temperature refrigerant flowing into the gas-liquid separator 1 is more uniform, which facilitates improving the heat exchange efficiency. Certainly, five distribution openings 432 may also be provided to equally divide the second side wall 423, as long as the refrigerant flows in uniformly, which is not limited herein. Similarly, multiple confluence openings 542 may also be uniformly provided, which is not limited herein. Further, the side wall of the distribution portion 4 and/or the lower sealing cover 5 may further be provided with other step faces, to position-limit or seal the first cylinder 2 and the second cylinder 3.

Further, as shown in FIGS. 2 and 3, the lowest end of the flow guide pipe 22 may be provided with a drain hole 220. Thereby, liquid refrigerant carried in the gaseous refrigerant is reduced. In the present application, the low temperature refrigerant flows into the gas-liquid separator 1 through the first through hole 401 arranged on the distribution portion 4. Specifically, the lower temperature liquid refrigerant sinks to the bottom of the second chamber 201 due to gravity. The lower temperature gaseous refrigerant flows into the first hole 430 through the free end 221 of the flow guide pipe 22, and passes through multiple distribution holes 431 arranged in the distribution portion 4, flows into the first chamber 20 through the multiple distribution openings 432, and exchanges heat with the high temperature refrigerant flowing in the heat exchange pipe 21, and finally flows out of the second hole 540 after gathering through the multiple confluence openings 542 arranged on the lower sealing cover 5, then flows into the compressor.

Further, referring to FIG. 3, the gas-liquid distribution assembly includes the flow guide pipe 22 and the connecting pipe 402. The flow guide pipe 22 is U-shaped, and one end thereof is higher than the other end. The higher end is communicated to the first hole 430, and the lower end is a free end 221. The free end 221 is spaced apart from the second end face 41 with a predetermined distance. The connecting pipe 402 communicates to the first through hole 401. The lower end face 4021 of the connecting pipe 402 is lower than the free end 221, after the gas-liquid mixed state refrigerant flows into the second chamber 201 via the connecting pipe 402, the liquid refrigerant sinks due to gravity, and the gaseous refrigerant rises and flows into the U-shaped flow guide pipe 22 from the free end 221. Further, as shown in FIGS. 3 and 5, a molecular sieve 24 may further be provided in the first cylinder 2.

FIGS. 14 to 24 shows a heat exchange system according to another exemplary embodiment of the present application, which includes an evaporator, a condenser, an expansion valve and a compressor which are connected by pipelines. The gas-liquid separator 1 is disposed between the evaporator and the compressor.

Figure 15:
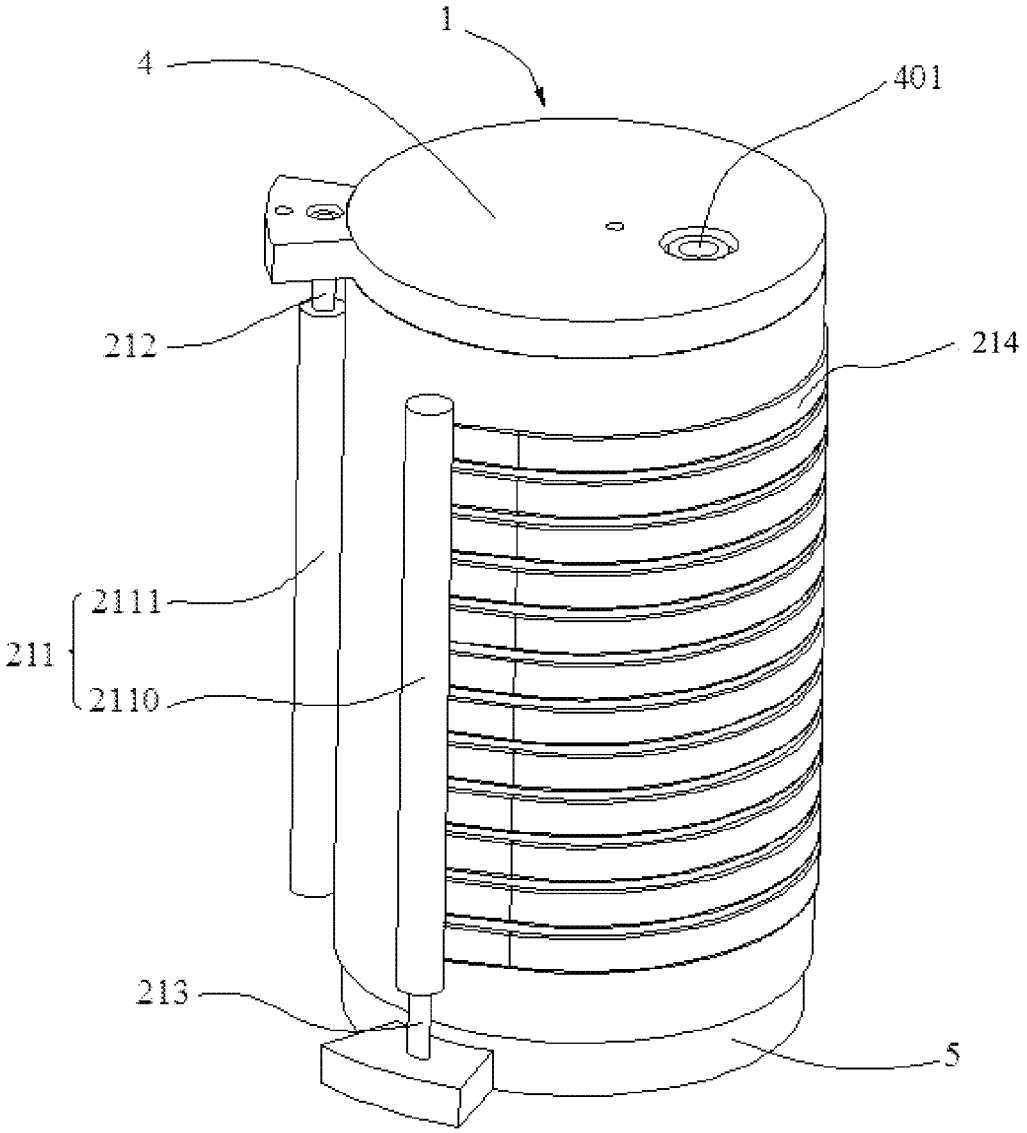
FIG. 15 is a schematic perspective view showing the assembly of a gas-liquid separator according to a fifth exemplary embodiment of the present application.
Figure 16:
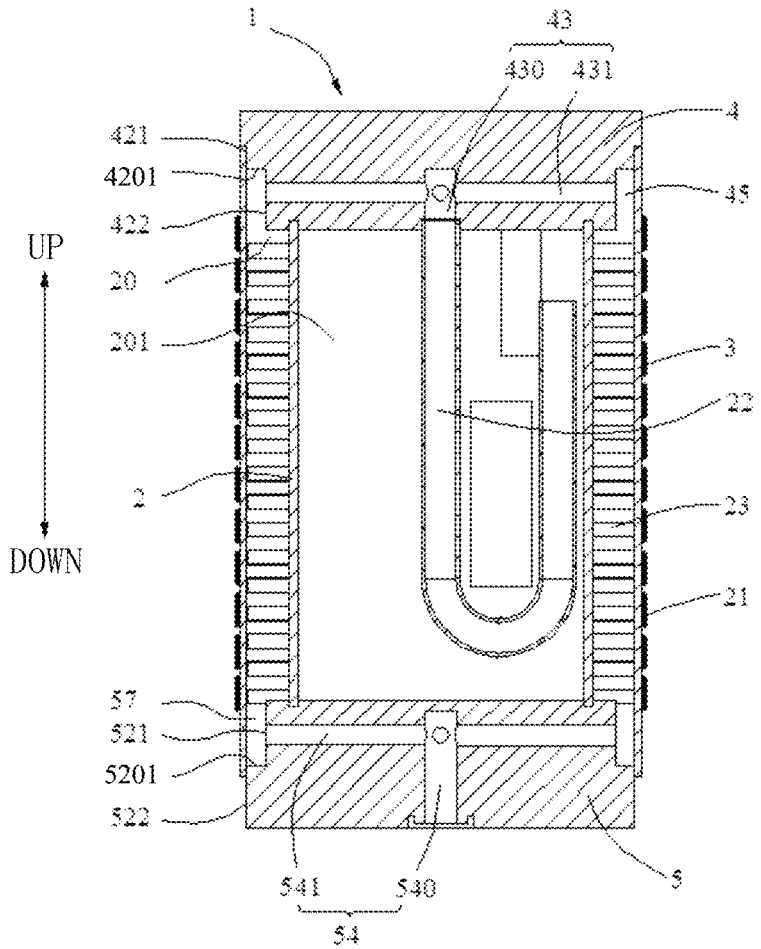
FIG. 16 is a schematic sectional view showing the assembly of the gas-liquid separator according to the fifth exemplary embodiment of the present application.

As shown in FIGS. 15 and 16, the gas-liquid separator 1 includes the first cylinder 2 and the second cylinder 3 spaced apart from the first cylinder 2 with a predetermined distance and sleeved outside the first cylinder 2. The first chamber 20 for flowing the refrigerant is provided between the first cylinder 2 and the second cylinder 3.

At least part of the inner wall of the second cylinder 3 mates with the heat exchange pipe 21. The distribution portion 4 covers the upper end of the second cylinder 3.

According to an embodiment of the present application, both the first cylinder 2 and the second cylinder 3 are hollow cylinders, and the outer diameter of the first cylinder 2 is smaller than the inner diameter of the second cylinder 3. The second chamber 201 is formed in the first cylinder 2, and the gas-liquid distribution assembly is disposed in the second chamber 201.

According to another embodiment of the present application, each of the first cylinder 2 and the second cylinder 3 has the annular side wall and the bottom wall 25. The upper end of the first cylinder 2 further may be covered with the end cap. The second chamber 201 is provided in the first cylinder 2, and the gas-liquid distribution assembly is disposed in the second chamber 201.

The first chamber 20 is a chamber enclosed by the outer wall face of the first cylinder 2 and the inner wall face of the second cylinder 3. The lower end face of the first cylinder 2 is higher than the lower end face of the second cylinder 3.

Figure 21:
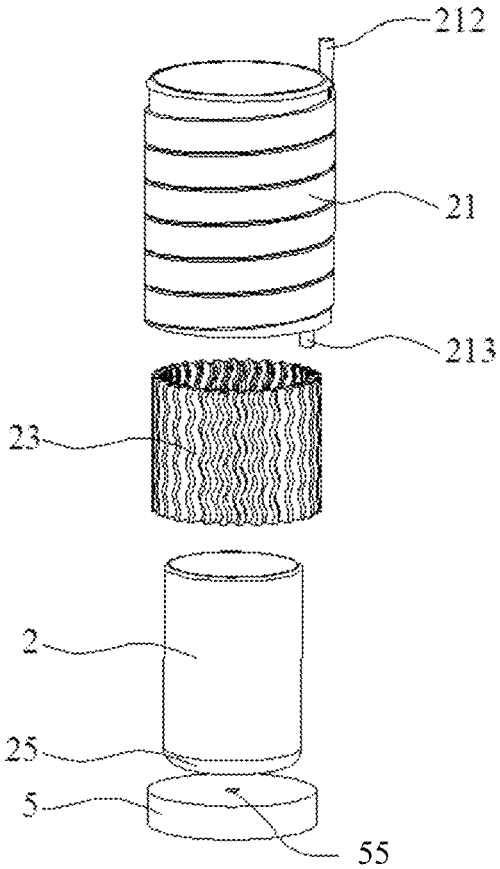
FIG. 21 is a schematic exploded view of a heat exchange zone of a gas-liquid separator according to a seventh exemplary embodiment of the present application.

As shown in FIGS. 16 and 21, the heat dissipation member 23 is provided in the first chamber 20. The heat dissipation member 23 is connected to the outer wall face of the first cylinder 2 and the inner wall face of the second cylinder 3, or the heat dissipation member 23 is only connected to the outer wall face of the first cylinder 2, or the heat dissipation member 23 is only connected to the inner wall face of the second cylinder 3. In some embodiments, the heat dissipation member 23 is connected to the first cylinder 2 and/or the second cylinder 3 by brazing. The heat dissipation member 23 is arranged in the first chamber 20 to strengthen heat exchange performance. In the present embodiment, as shown in FIGS. 23 and 24, the heat dissipation member 23 is formed by successively connecting multiple sheet-shaped units of a curved shape end to end, to increase the heat dissipation area. Protrusions of the curved shape of the heat dissipation fins of any two adjacent columns or rows are alternately distributed, effectively improving the disturbance to the refrigerant to be exchanged heat.

Further, the first chamber 20 is the low temperature refrigerant passageway, and the heat exchange pipe 21 is the high temperature refrigerant passageway. According to an embodiment of the present application, as shown in FIGS. 15 and 16, the heat exchange pipe 21 includes multiple flat tubes 214 arranged in parallel in the same direction and covering the outer wall face of the second cylinder 3. The heat exchange pipe 21 mates with the outer wall face of the second cylinder 3. The high temperature refrigerant passageway and the low temperature refrigerant passageway of the gas-liquid separator 1 are provided separately, which has a relatively simple structure and can also effectively avoid the risk of mixing refrigerants in two states after the pipeline leakage occurs. In another embodiment, the outer wall face of the heat exchange pipe 21 fits the outer wall face of the second cylinder 3. The heat exchange pipe 21 is the flat tube 214 covered on the outer wall face of the second cylinder 3 in a spiral winding manner.

Further, as shown in FIG. 15, the heat exchange pipe 21 includes multiple flat tubes 214 arranged in parallel with each other and the collecting pipe 211 is in communication with the flat tubes 214. The heat exchange pipe 21 is inserted in the collecting pipe 211. The high temperature refrigerant flows in the same direction in the flat tube 214. The heat exchange pipe 21 fits the outer wall face of the second cylinder 3, the outer wall of the flat tube 214 contacts with the inner wall of the second cylinder 3. The high temperature refrigerant flowing in the flat tube 214 directly exchanges heat with the heat dissipation member 23 to provide a high heat dissipation efficiency.

As shown in FIG. 15, the collecting pipe 211 may include a first collecting pipe 2110 and a second collecting pipe 2111. One end of the flat tube 214 is inserted to the first collecting pipe 2110, and the other end is inserted to the second collecting pipe 2111. The first collecting pipe 2110 has a second connector 213, and the second collecting pipe 2111 has a first connector 212. The high temperature refrigerant flows into the first collecting pipe 2110 from the first connector 212 and flows along the flat tube 214, flows out of the second connector 213 via the second collecting pipe 2111 after the heat exchange.

The opening direction of the first connector 212 is opposite to the opening direction of the second connector 213.

As shown in FIG. 16, the gas-liquid separator 1 further includes the distribution portion 4 which covers the upper end of the second cylinder 3, and the upper end face of the first cylinder 2 abuts against the distribution portion 4.

Figure 17:
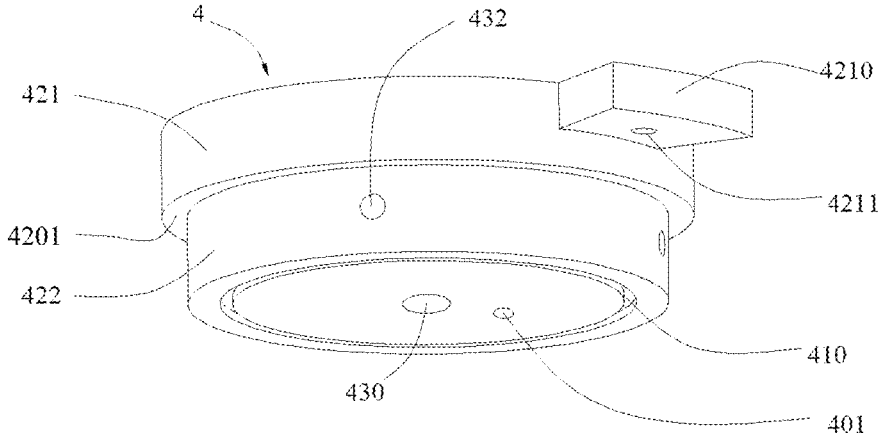
FIG. 17 is a schematic view of a distribution portion of the gas-liquid separator according to the fifth exemplary embodiment of the present application.
Figure 19:
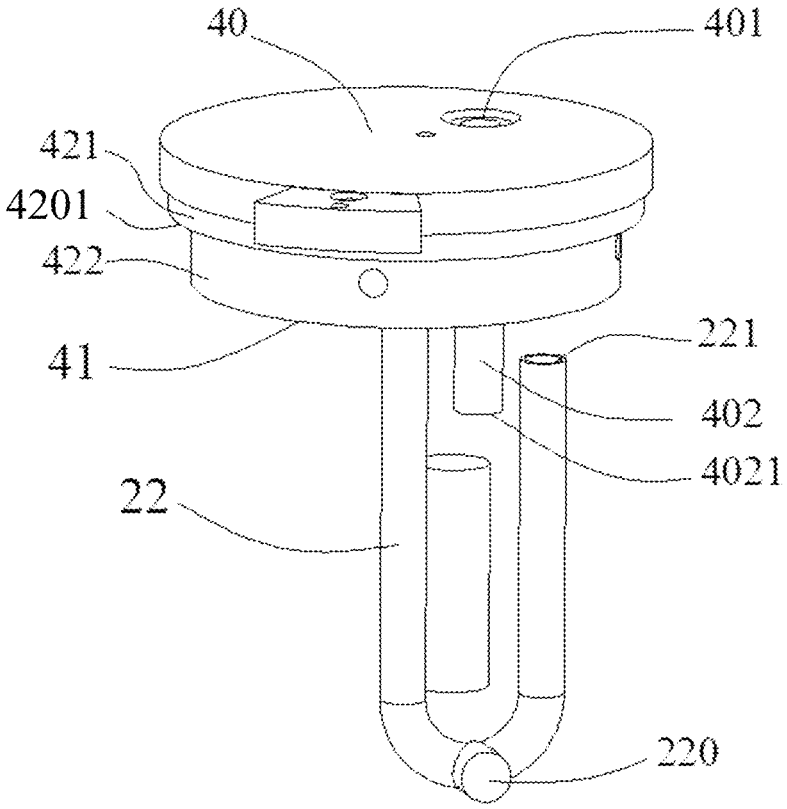
FIG. 19 is a schematic view showing the assembly of the distribution portion and the flow guide pipe of the gas-liquid separator according to the fifth exemplary embodiment of the present application.

As shown in FIGS. 17 and 19, the distribution portion 4 is approximately a cylinder shape. The distribution portion 4 includes the first end face 40 away from the second cylinder 3, the second end face 41 opposite to the first end face 40, and the step face 4201. The first step face 4201 divides the side wall face of the distribution portion 4 into two segments, that is, the first side wall face 421 and the second side wall face 422. The outer section of the first step face 4201 is connected to the first side wall face 421, and the inner section of the first step face 4201 is connected to the first surface 422.

Further, as shown in FIGS. 16 and 17, the first through hole 401 penetrating through the first end face 40 and the second end face 41 is provided at a place of the distribution portion 4 deviating from the axis of the distribution portion 4. The first through hole 401 is in communication with the second chamber 201. The multiple first passageways 43 are provided in the distribution portion 4. In some embodiments, the first passageway 43 is arranged along the radial direction of the distribution portion 4. At least part of the first passageway 43 is in communication with the first chamber 20 and the second chamber 201.

As shown in FIGS. 15 and 19, the lower end opening of the first through hole 401 is in communication with the connecting pipe 402 extending downwardly. The low temperature refrigerant with gas-liquid two phase state may flow into the second chamber 201 through the first through hole 401 to complete the separation of gas and liquid.

Figure 20:
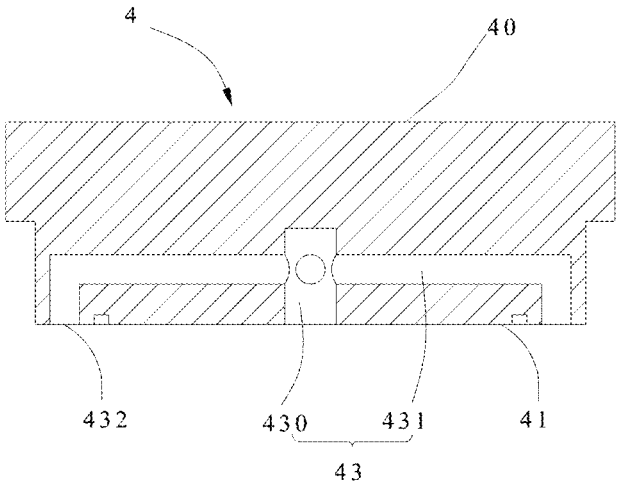
FIG. 20 is a schematic sectional view of a distribution portion of a gas-liquid separator according to a sixth exemplary embodiment of the present application.

As shown in FIG. 20, at least part of the first passage 43 includes the distribution hole 431 which extends toward the interior of the distribution portion 4 and has the distribution opening 432 at the end deviating from the axis of the distribution portion 4. In some embodiments, the distribution hole 431 extends along the radial direction of the distribution portion 4. As shown in FIG. 17, the distribution portion 4 includes the first surface 422 which forms a part of the wall face of the first chamber 20, and the distribution opening 432 is disposed in the circumferential direction of the first surface 422.

At least part of the first passage 43 gathers at the axis of the distribution portion 4 and extends downward to form the first hole 430. The first hole 430 extends in the axial direction of the distribution portion 4, and penetrates the second end face 41 but does not penetrate the first end face 40. The first hole 430 is in communication with the distribution hole 431.

In the present embodiment, as shown in FIG. 16, the first hole 430 is in communication with the second chamber 201, thus the first chamber 20 is in communication with the second chamber 201. After the gas-liquid separation in the second chamber 201 by the low temperature refrigerant, the gaseous low temperature refrigerant is distributed into the first chamber 20 via the first passage 43 in the distribution portion 4, and the low temperature refrigerant in the first chamber 20 exchanges heat with the high temperature refrigerant in the heat exchange pipe 21. As shown in FIGS. 16 and 19, the flow guide pipe 22 communicated to the first hole 430 is disposed in the first cylinder 2. The flow guide pipe 22 includes the free end 221 which is spaced apart from the second end face 41 with a predetermined distance. The first cylinder 2 may further be provided with the connecting pipe 402 communicated to the through hole 401. The connecting pipe 402 has the lower end face 4021 which is not higher than the free end 221.

As shown in FIGS. 16 and 17, the upper end face of the first cylinder 2 is lower than the upper end face of the second cylinder 3. At least part of the first side wall face 421 fits the inner wall face of the second cylinder 3, that is, the height of the end face of the second cylinder 3 aligns with the height of the first end face 40 of the distribution portion 4, or the end face of the second cylinder 3 is lower than the first end face 40 of the distribution portion 4. A part of the first surface 422 fits the inner wall face of the first cylinder 2, and the remaining portion forms a part of the wall face of the first chamber 20, or the upper end of the first cylinder 2 abuts against the second end face 41. The first surface 422 forms a part of the wall face of the first chamber 20, and the first surface 422 is approximately a circular shape, the distribution opening 432 may be formed on a plane cut from the first surface 422. The upper end of the second cylinder 3 is not lower than the cutting plane. The gap 45 is formed between the inner wall face of the second cylinder 3 and the cutting plane, and the gap 45 belongs to a part of the first chamber 20. Therefore, the cutting plane forms a part of the wall face of the first chamber 20.

According to another embodiment of the present application, referring to FIGS. 19 and 20, the distribution opening 432 is located at the second end face 41. In some embodiments, the first surface 422 is perpendicular to the second end face 41. In some embodiments, an angle between the first surface 422 and the second end face 41 may further be acute angle or obtuse angle, which may be set according to the processing requirement. The distribution portion 4 further includes the first side wall face 421 and the first step face 4201 in which the inner section is connected to the first side wall face 421 and the outer section is connected to the first surface 422. The upper end face of the first cylinder 2 is lower than the upper end face of the second cylinder 3, at least part of the first side wall face 421 fits the inner wall face of the first cylinder 2. At least part of the first surface 422 forms a part of the wall face of the first chamber 20. The distribution openings 432 are arranged in the circumferential direction.

Further, as shown in FIG. 17, the first side wall face 421 of the distribution portion 4 extends outwardly to form a first lug 4210 defining a second through hole 4211 for the first connector 212 inserting therein. The first connector 212 is inserted into the first lug 4210 and penetrates through the first lug 4210.

According to another embodiment of the present application, as shown in FIG. 16, the gas-liquid separator 1 further includes the lower sealing cover 5 covering the lower end of the second cylinder 3. The flow passage 54 communicating the first chamber 20 and the external of the gas-liquid separator 1 is disposed in the lower sealing cover 5. The lower end of the first cylinder 2 abuts against the lower sealing cover 5. The first cylinder 2 has the annular side wall and the bottom wall 25. The lower sealing cover 5 is provided with the second hole 540 penetrating through the upper surface and the lower surface thereof. The second hole 540 discharges the gaseous refrigerant out of the gas-liquid separator 1 after the heat exchange process.

Figure 22:
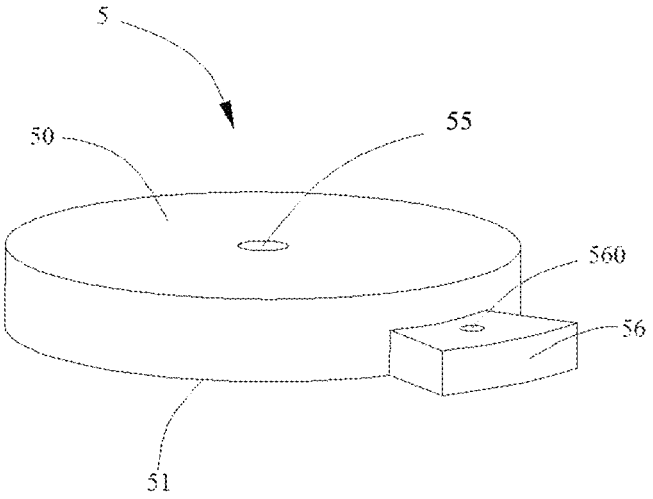
FIG. 22 is a schematic view of a lower sealing cover of a gas-liquid separator according to an eighth exemplary embodiment of the present application.

Further, as shown in FIGS. 21 and 22, the lower sealing cover 5 is provided with a third through hole 55 penetrating through the upper surface and the lower surface of the lower sealing cover 5. The third through hole 55 makes the first chamber 20 be in communication with the gas-liquid separator 1, and discharges the gaseous refrigerant out of the gas-liquid separator 1 after the heat exchange. The third through hole 55 is arranged at the axis position of the lower sealing cover 5. The gap is defined between the bottom wall 25 of the first cylinder 2 and the lower sealing cover 5, and the support member is arranged between the bottom wall 25 and the lower sealing cover 5, which facilitates the discharge of the gaseous refrigerant from the third through hole 55.

As shown in FIG. 22, the side wall face of the lower sealing cover 5 extends outwardly to form a second lug 56. The second connector 213 is inserted into the second lug 56 and penetrates through the second lug 56. The second lug 56 is provided with a fourth through hole 560 in communication with the second connector 213.

Figure 18:
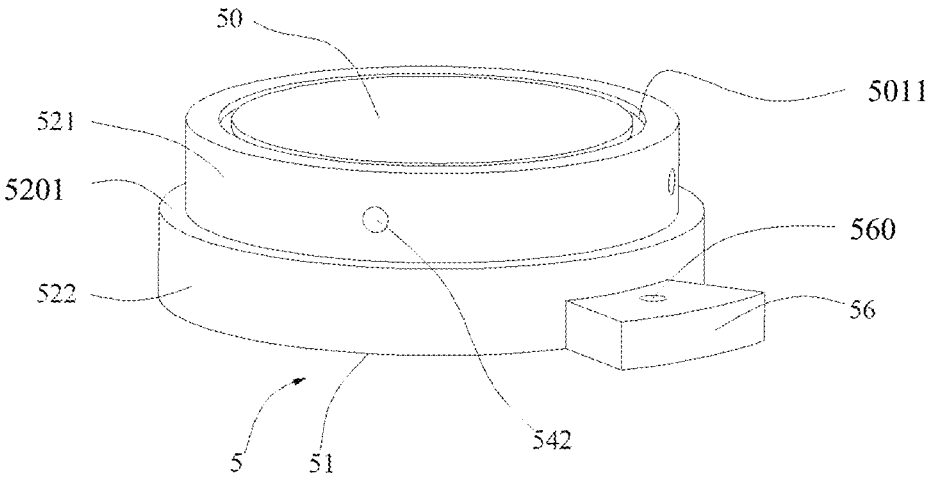
FIG. 18 is a schematic view of a lower sealing cover of the gas-liquid separator according to the fifth exemplary embodiment of the present application.

According to another embodiment of the present application, as shown in FIG. 18, neither the first cylinder 2 nor the second cylinder 3 have the bottom wall, at this time, the lower sealing cover 5 is approximately circular and includes a third end face 50, a fourth end face 51 and a second step face 5201. The second step face 5201 divides the second side wall 52 into two segments, that is, a second surface 521 and a third side wall face 522. The inner portion of the second step face 5201 is connected to the second surface 521 and the outer portion is connected to the third side wall face 522. The second surface 521 is provided with multiple confluence openings 542 in the circumferential direction of the second surface.

The flow passage 54 penetrates through the upper surface and the lower surface of the lower sealing cover 5. Specifically, as shown in FIG. 16, the flow passage 54 includes the second hole 540 and the confluence hole 541. The second hole 540 penetrates through downwardly the lower end face of the lower sealing cover 5 from the inside of the lower sealing cover 5, and the confluence hole 541 extends toward the interior of the lower sealing cover 5 to be in communication with the second hole 540. In some embodiments, the confluence hole 541 extends in the radial direction of the lower sealing cover 5. The confluence hole 541 has the confluence opening 542. The second surface 521 forms a part of the wall face of the first chamber 20. The second surface 521 is perpendicular to the upper surface of the lower sealing cover 5.

At least part of the second surface 521 fits the inner wall face of the first cylinder 2. Multiple confluence openings 542 are arranged along the circumferential direction of the second surface 521. The flow passage 54 allows the first chamber 20 to be in communication with the external of the gas-liquid separator 1.

Further, as shown in FIG. 18, in order to improve the reliability of assembling the first cylinder 2 to the lower sealing cover 5, the upper end face of the lower sealing cover 5, that is, the third end face 50 is provided with a second groove 5011 matching the lower end portion of the first cylinder 2. Similarly, as shown in FIG. 17, in order to improve the reliability of assembling the first cylinder 2 to the distribution portion 4, the lower end face of the distribution portion 4 is provided with a first groove 410 matching the upper end portion of the first cylinder 2. Specifically, the first groove 410 is arranged in the second end face 41. The third side wall face 522 extends outwardly to form the second lug 56.

As shown in FIG. 16, the upper end of the second cylinder 3 abuts against the first step face 4201 or the inner wall face of the second cylinder 3 is welded to the first side wall face 421. The lower end of the second cylinder 3 abuts against the second step face 5201 or the inner wall face of the second cylinder 3 is welded to the third side wall face 522, to achieve the sealing for the second cylinder 3. The upper end of the first cylinder 2 abuts against the second end face 41, and the lower end abuts against the third end face 50 and is accommodated in the second groove 5011, to achieve the sealing for the first cylinder 2.

Further, the first gap 45 is formed between the first surface 422 and the second cylinder 3, so that the distribution opening 432 is in communication with the first chamber 20. The second gap 57 is formed between the second surface 521 and the second cylinder 3, so that the confluence opening 542 is in communication with the first chamber 20. In order to ensure that the low temperature refrigerant uniformly flows into/flows out of the first chamber 20, the distribution opening 432 and the confluence opening 542 are generally uniformly arranged. In the present embodiment, four distribution openings 432 which are in communication with each other are provided. The distribution openings 432 equally divide the first surface 422, so that the distribution of the low temperature refrigerant flowing into the gas-liquid separator 1 is more uniform, which facilitates improving the heat exchange efficiency. Three distribution openings 432 may also be provided and equally divide the first surface 422, as long as the refrigerant flows in uniformly, which is not limited herein. Similarly, multiple confluence openings 542 may also be uniformly provided, which is not limited herein.

Further, the side wall of the distribution portion 4 and/or the lower sealing cover 5 may further be provided with a third step face for position-limiting the second cylinder 3 and ensuring that the gap is formed between the first surface 422, the second surface 521 and the second cylinder 3.

Further, as shown in FIG. 16, the lowest end of the flow guide pipe 22 is provided with a drain hole 220. Thereby, liquid refrigerant carried in the gaseous refrigerant is reduced. In the present application, the low temperature refrigerant flows into the gas-liquid separator 1 through the first through hole 401 in the distribution portion 4. Specifically, the lower temperature liquid refrigerant sinks to the bottom of the second chamber 201 due to gravity. The lower temperature gaseous refrigerant flows into the first passage 430 through the free end 221 of the flow guide pipe 22, and passes through multiple first passages 43 dispose in the distribution portion 4, flows into the first chamber 20 through the multiple distribution openings 432, and exchanges heat with the high temperature refrigerant flowing in the heat exchange pipe 21, then flows out of the second hole 540 after gathering through the multiple confluence openings 542 arranged on the lower sealing cover 5, and finally flows into the compressor.

Further, referring to FIG. 19, the gas-liquid distribution assembly includes the flow guide pipe 22 and the connecting pipe 402. The flow guide pipe 22 is U-shaped, and one end thereof is higher than the other end. The higher end is connected to the first hole 430, and the lower end is the free end 221. The lower end face 4021 of the connecting pipe 402 is lower than the free end 221. Thus, after the gas-liquid mixed state refrigerant flows into the second chamber 201 via the connecting pipe 402, the liquid refrigerant sinks due to gravity, and the gaseous refrigerant rises and flows into the U-shaped flow guide pipe 22 from the free end 221. Further, the molecular sieve 24 may further be provided in the first cylinder 2.

The above are only the better embodiments of the present application and are not intended to limit the present application. Any changes, equivalent substitutions, improvements and the like made within the spirit and principles of the present application are all contained in the protection scope of the present application.

The invention claimed is:

1. A gas-liquid separator, comprising:

a first cylinder and a second cylinder, the first cylinder located at an inner side of the second cylinder;

a first chamber and a second chamber communicated with each other, the first chamber located in the second cylinder and outside the first cylinder, the second chamber at least comprising a space located inside the first cylinder;

a heat exchange pipe, at least part of the heat exchange pipe disposed in the first chamber;

a distribution portion fixed to the second cylinder, the distribution portion defining a first passage;

a flow guide pipe fixed to the distribution portion, one end of the first passage communicated with one end of the flow guide pipe, the other end of the first passage communicated with the first chamber, the other end of the flow guide pipe communicated with the second chamber; and a lower sealing cover with a flow passage, the lower sealing cover fixed to the second cylinder, the lower sealing cover and the distribution portion disposed at two opposite sides of the second cylinder along an axis direction of the second cylinder, the flow passage communicated with the first chamber, wherein the distribution portion is fixedly connected to the second cylinder by welding or bonding;

the gas-liquid separator further comprises a connecting pipe fixed to the distribution portion, at least part of the connecting pipe and at least part of the flow guide pipe are located in the second chamber, and the distribution portion defines a first through hole communicated to the connecting pipe.

2. The gas-liquid separator according to claim 1, wherein the distribution portion further comprises a first side wall face, a first step face and a plurality of distribution openings, an outer portion of the first step face is connected to the first side wall face and an inner portion of the first step face is connected to a first surface, and the distribution openings are arranged along a circumferential direction of the first surface.

3. The gas-liquid separator according to claim 1, wherein the lower sealing cover is mounted to a lower end of the second cylinder, and the lower sealing cover defines a plurality of flow passages communicating the first chamber and an external of the gas-liquid separator.

4. The gas-liquid separator according to claim 1, wherein the heat exchange pipe contacts with an outer wall face of the second cylinder.

5. The gas-liquid separator according to claim 1, wherein a heat dissipation member is provided in the first chamber, the heat dissipation member is bent into a cylinder shape, and the heat dissipation member is connected to an outer wall face of the first cylinder and/or an inner wall face of the second cylinder.

6. A heat exchange system, comprising an evaporator, a compressor and the gas-liquid separator according to claim 1, wherein the gas-liquid separator is communicated between the evaporator and the compressor, an outlet of the evaporator is connected to an inlet of the gas-liquid separator, and the compressor is connected to an outlet of the gas-liquid separator.

7. The gas-liquid separator according to claim 1, wherein the distribution portion further comprises a first side wall face, a second side wall face and a step face, an outer section of the step face is connected to the first side wall face, an inner section of the step face is connected to the second side wall face, a part of the second side wall face is recessed inwardly to form a first surface, an upper end face of the second cylinder abuts against the step face, and a first gap is defined between the first surface and an inner wall face of the second cylinder.

8. The gas-liquid separator according to claim 7, wherein the distribution portion comprises a restricting portion extending downwardly from the second end face, and a side wall face of the restricting portion contacts with the inner wall face of the first cylinder.

9. The gas-liquid separator according to claim 1, wherein the heat exchange pipe is wound in a same direction to form a substantial cylinder shape, one end of the heat exchange pipe is provided with a first connector connected to the distribution portion, and the other end of the heat exchange pipe is provided with a second connector connected to the lower sealing cover.

10. The gas-liquid separator according to claim 9, wherein an opening direction of the first connector is opposite to an opening direction of the second connector, a side wall face of the distribution portion extends outwardly to form a first lug, the first connector is inserted into the first lug and penetrates through the first lug, a side wall face of the lower sealing cover extends outwardly to form a second lug, and the second connector is inserted into the second lug and penetrates through the second lug.

11. The gas-liquid separator according to claim 1, wherein the heat exchange pipe comprises a plurality of flat tubes arranged in parallel with each other, one end of the flat tubes is connected with a first collecting pipe, the other end of the flat tubes is connected with a second collecting pipe, and the first collecting pipe and the second collecting pipe are arranged substantially in parallel with each other.

12. The gas-liquid separator according to claim 11, wherein one end of the first collecting pipe is provided with a first connector connected to the distribution portion, the other end of the first collecting pipe is provided with a second connector connected to the lower sealing cover, the first collecting pipe is provided with a partition plate dividing the first collecting pipe into a plurality of independent chambers arranged in an axial direction of the first collecting pipe.

13. The gas-liquid separator according to claim 11, wherein the second collecting pipe comprises a leakproof end cap and a collecting pipe wall, a header chamber of the second collecting pipe is at least located between the leakproof end cap and the collecting pipe wall.

14. The gas-liquid separator according to claim 1, wherein the first passage defines a distribution hole, the distribution hole is in communication with the first chamber and the second chamber, and a peripheral wall portion of the distribution portion is configured as a part of a wall defining the first chamber.

15. The gas-liquid separator according to claim 14, wherein the distribution portion comprises a first end face facing the second chamber and a second end face externally exposed to the gas-liquid separator, the first passage comprises a first hole communicated with the distribution hole, the first hole penetrates through the second end face but does not penetrate through the first end face, a part of the flow guide pipe is inserted into the first hole, and the first hole is in communication with a pipe chamber of the flow guide pipe.

16. The gas-liquid separator according to claim 15, wherein the flow guide pipe is connected with the distribution portion, the flow guide pipe comprises a free end, and a vertical distance between the free end and the second end face is smaller than a vertical distance between the connecting pipe and the second end face.

17. The gas-liquid separator according to claim 15, wherein the distribution portion comprises a connecting portion extending upwardly from a part of the first end face, a part of a first side wall face extends upwardly to form a side wall face of the connecting portion, the connecting portion further comprises a third side wall with a first groove, after the first groove extends toward an interior of the connecting portion by a predetermined distance, the first groove extends downwardly in a direction parallel to an axis of the distribution portion and penetrates the second end face to be in communication with the first chamber.

18. The gas-liquid separator according to claim 17, wherein the third side all defines a second groove extending toward the interior of the connecting portion by a predetermined distance and further extends downwardly in a direction parallel to the axis of the distribution portion to be in communication with the first through hole.

* * * * *